US006520054B1

(12) United States Patent
Wang

(10) Patent No.: US 6,520,054 B1
(45) Date of Patent: Feb. 18, 2003

(54) COMBINATION BICYCLE TOOL KIT

(76) Inventor: Lo-Pin Wang, 16F-2, No. 17, Lane 52, Sec. 3, Re He Rd., Taichung (TW)

( * ) Notice: Subject to any disclaimer, the term of this patent is extended or adjusted under 35 U.S.C. 154(b) by 0 days.

(21) Appl. No.: 09/955,149

(22) Filed: Sep. 19, 2001

(51) Int. Cl.[7] ..... B25B 23/00
(52) U.S. Cl. ..... 81/440; 7/138; 224/425
(58) Field of Search ..... 81/437, 439, 440, 81/177.4, 490; 224/425, 463, 572; 7/138

(56) References Cited

U.S. PATENT DOCUMENTS 589,402 A * 9/1897 Badgley ..... 224/425
607,599 A * 7/1898 Deitsch et al. ..... 224/425
1,801,443 A * 4/1931 Mesinger ..... 224/425
RE37,210 E * 6/2001 Chuang ..... 81/440

* cited by examiner

*Primary Examiner*—Eileen P. Morgan
*Assistant Examiner*—Joni B. Danganan
(74) *Attorney, Agent, or Firm*—Browdy and Neimark, P.L.L.C.

(57) ABSTRACT

A combination bicycle tool kit includes a case, the case having a receiving open chamber and a positioning groove for attaching to a tubular member, a first tool set receivable in the receiving open chamber, a second tool set detachably secured to the outside wall of the case, the first and second tool sets each having a tool holder base and a set of tools pivoted to a pivot shaft at one end of the tool holder base and turned in and out of the tool holder base between the operative position and the non-operative position, and an elastic band adapted to secure the case to one tubular member of the frame of a bicycle.

10 Claims, 6 Drawing Sheets

COMBINATION BICYCLE TOOL KIT

BACKGROUND OF THE INVENTION

The present invention relates to tool kits and, more particularly, to a combination bicycle tool kit, which is convenient for carrying on the bicycle.

A variety of combination tool kits have been disclosed. Taiwan patent no. 414131 discloses a multipurpose tool kit, which comprises two tool sets. Each tool set comprises a base plate, and a set of tool elements. One tool set has a male retainer means. The other tool set has a female retainer means that can be fastened to the male retainer means, keeping the tool sets secured together. This design of multipurpose tool kit is functional, however it is inconvenient in use. When using one particular tool element, the two tool sets must be separated from each other. Further, when carrying the multipurpose tool kit on a bicycle, a tool case or container means must be used to keep the multipurpose tool kit in place.

SUMMARY OF THE INVENTION

The present invention has been accomplished to provide a combination bicycle tool kit, which eliminates the aforesaid drawbacks. It is the main object of the present invention to provide a combination bicycle tool kit, which is convenient for carrying by hand as well as on a bicycle. To achieve this and other objects of the present invention, the combination bicycle tool kit comprises a case, the case having a receiving open chamber extended to one end thereof and a coupling structure integral with one sidewall thereof; a first tool set, the first tool set comprising a tool holder base, the holder base comprising a pivot shaft transversely disposed at one end thereof, a chamfered edge disposed at an opposite end thereof, and a set of tool bits respectively pivoted to the pivot shaft and turned about the pivot shaft between the operative position where the tool bits are extended out of the tool holder base, and the non-operative position where the tool bits are received inside the tool holder base; and a second tool set, the second tool set comprising a tool holder base, the holder base comprising a pivot shaft transversely disposed at one end thereof and a chamfered edge disposed at an opposite end thereof, a coupling structure integral with the tool holder base for fastening to the coupling structure of the case the secure the second tool set to the case, and a set of tool elements respectively pivoted to the pivot shaft and turned about the pivot shaft between the operative position where the tool elements are extended out of the tool holder base, and the non-operative position where the tool elements are received inside the tool holder base.

DETAILED DESCRIPTION OF THE PREFERRED EMBODIMENT

Figure 1:
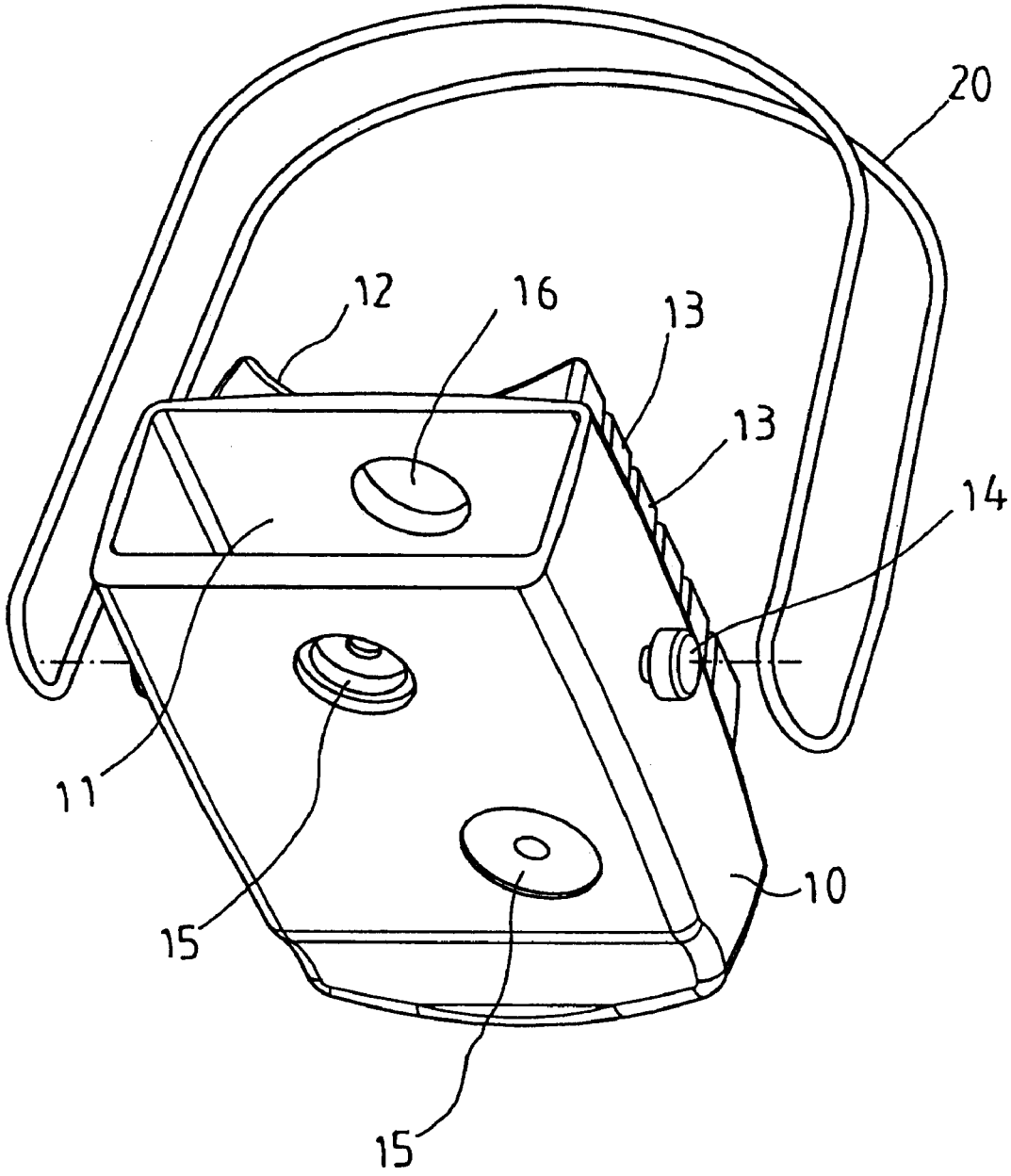
FIG. 1 is an elevational view of a case and an elastic band for a combination bicycle tool kit according to the present invention.

Referring to FIGS. from 1 through 6, a combination bicycle tool kit in accordance with the present invention is shown comprised of a case 10, a fastener 20, a first tool set 30, and a second tool set 40.

Figure 2:
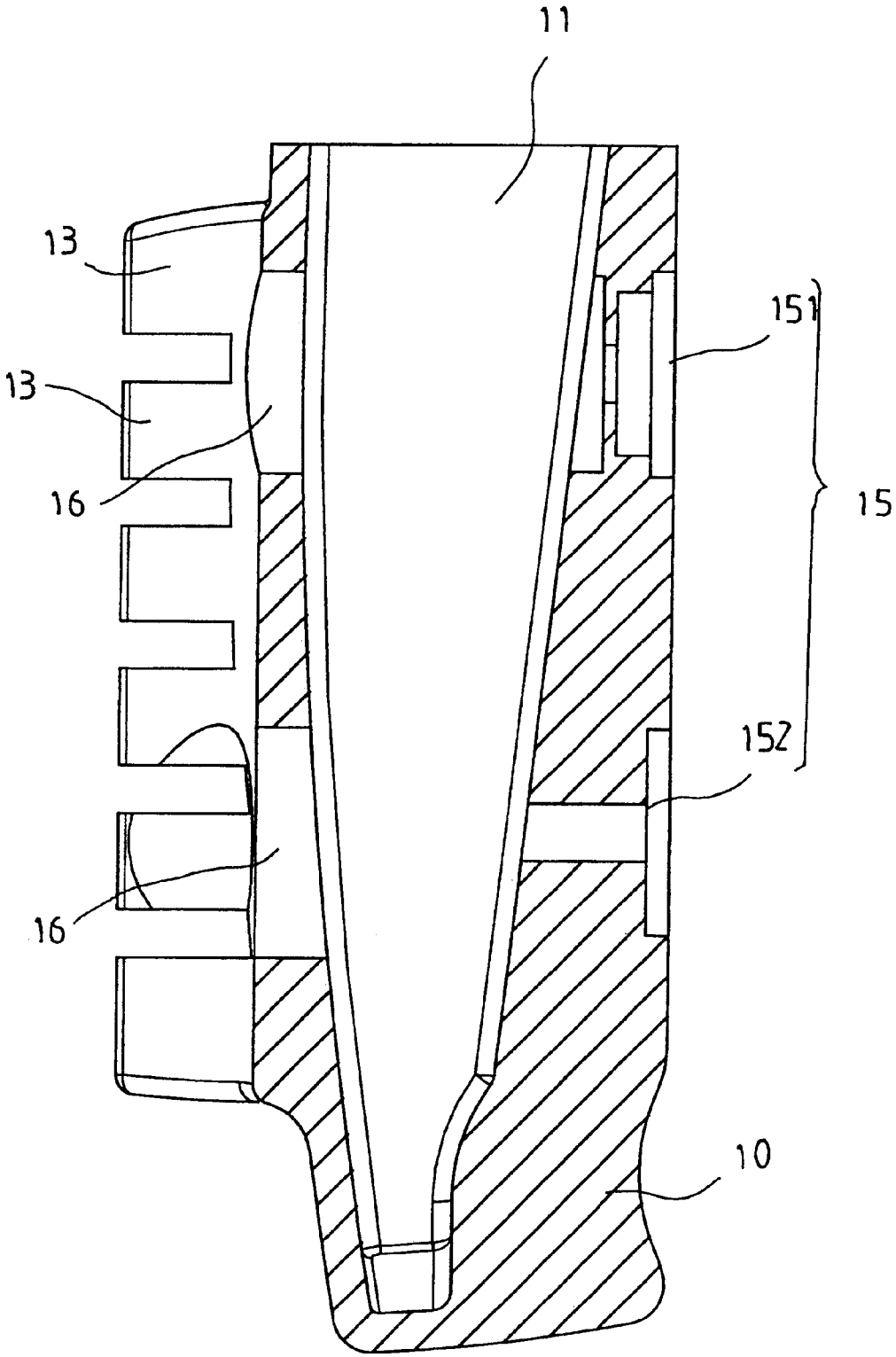
FIG. 2 is a sectional view in an enlarged scale of the case shown in FIG. 1.
Figure 6:
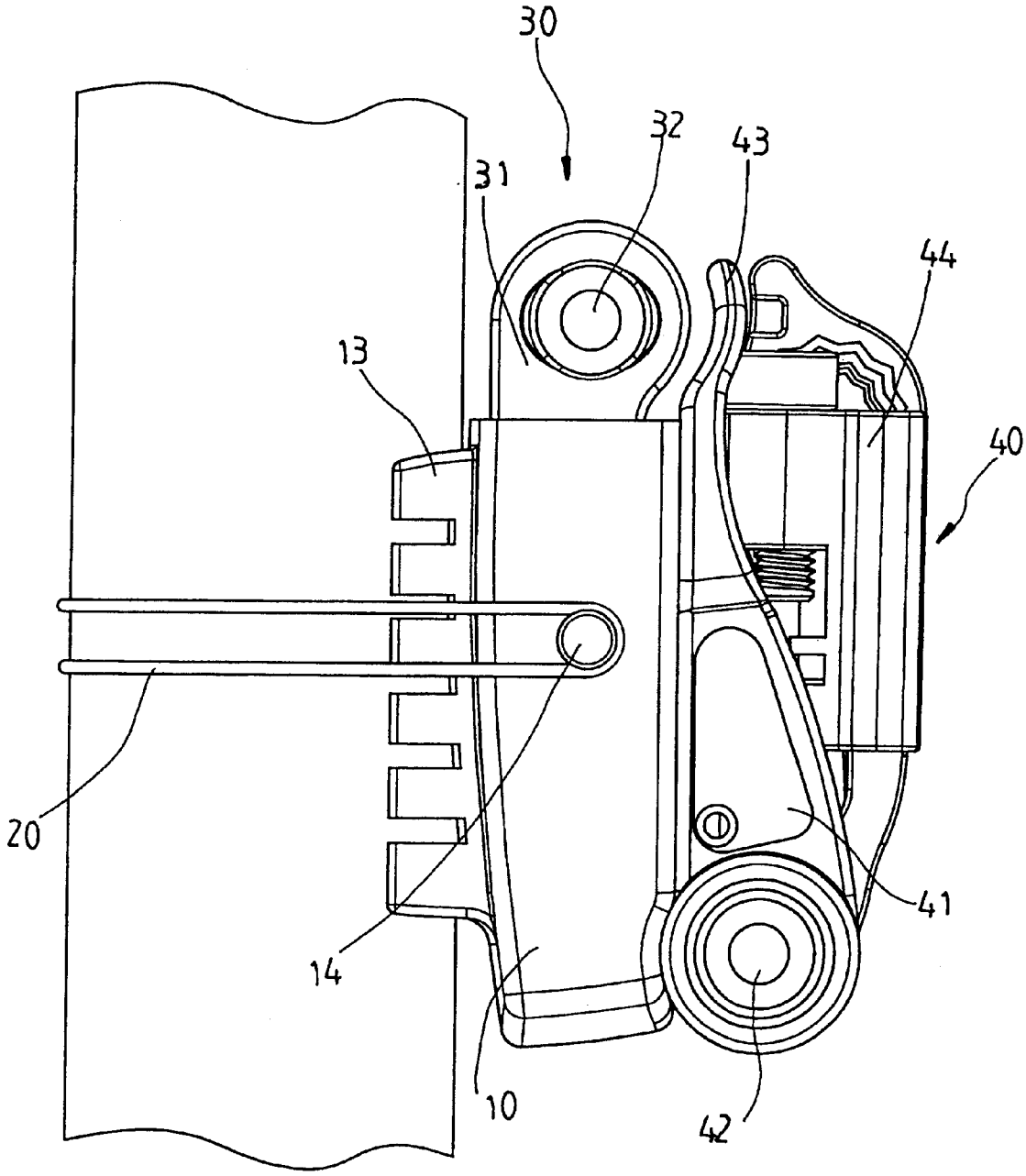
FIG. 6 is a side view of the present invention, showing the combination bicycle tool kit fastened to a tubular member.

The case 10, as shown in FIG. 1 (the description below regarding the direction of the case is based on the direction of FIG. 1), has a substantially rectangular cross-section, a receiving open chamber 11 extended to one end thereof, a plurality of ribs 13 disposed at the back side thereof and defining a positioning groove 12 that fits the periphery of a tube (see FIG. 6), two lugs 14 respectively disposed at two opposite lateral sides, and a coupling structure 15 provided at the front side thereof for securing the second tool set 40. According to the present preferred embodiment, the coupling structure 15 comprises a female retainer means 151 (for example a socket of a snap fastener) and a female retainer means 152 (for example a socket of a snap fastener) (See FIG. 2).

The fastener 20 can be a C-shaped clamp, a fastening strap, or an elastic band. According to the present preferred embodiment, the fastener 20 is an elastic band made of rubber. The elastic band 20 can be hung on the lugs 14 to secure the case 10 to one tubular member of the frame of a bicycle (see FIG. 6), keeping the positioning groove 12 of the case 10 engaged with the periphery of the tubular member.

Figure 3:
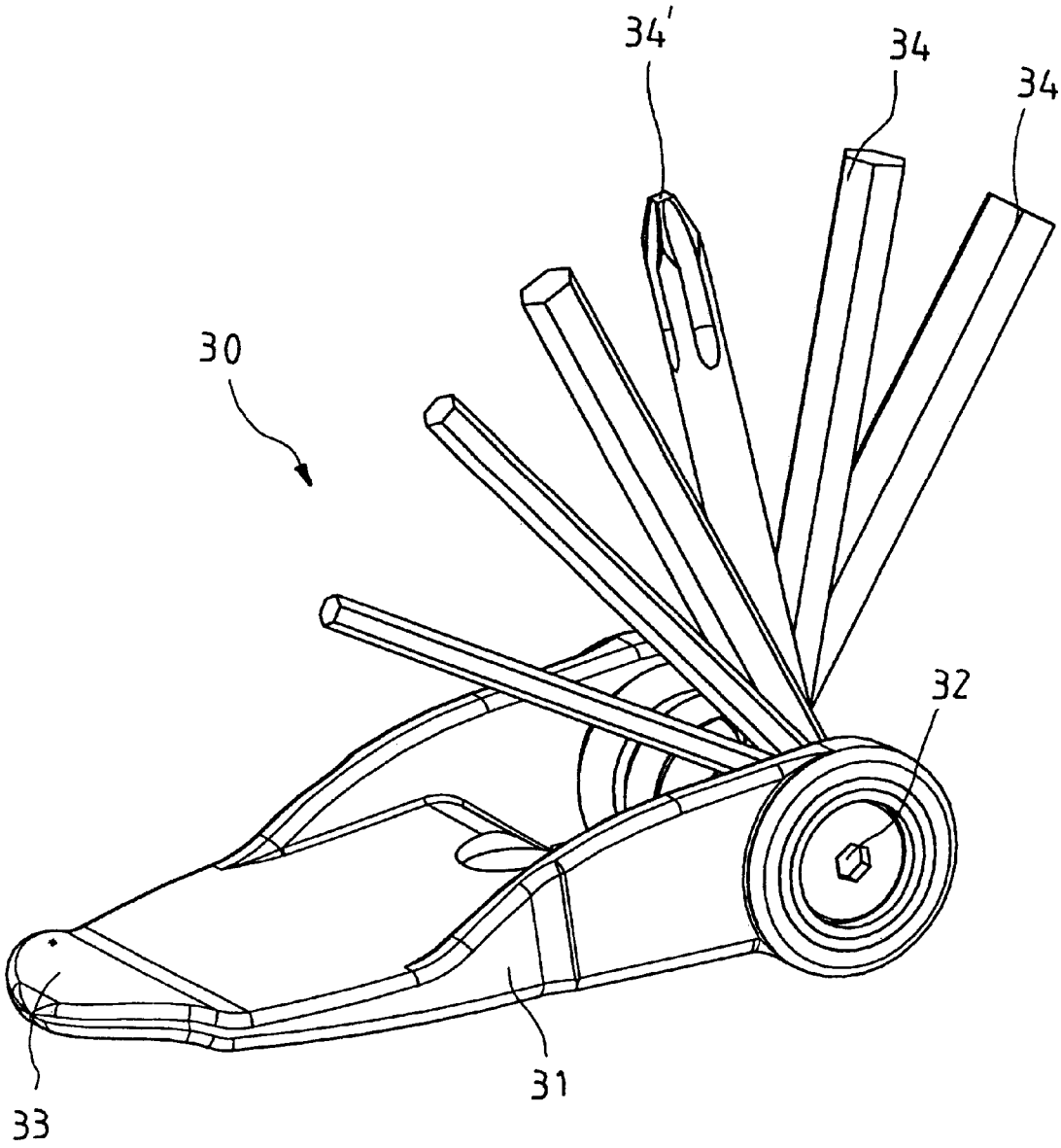
FIG. 3 is an extended view of a first tool set for the combination bicycle tool kit according to the present invention.

Referring to FIG. 3, the first tool set 30 comprises a tool holder base 31, the tool holder base 31 having a pivot shaft 32 transversely disposed at one end thereof and a chamfered edge 33 disposed at the other end thereof, and a set of tool bits 34 respectively pivoted to the pivot shaft 32 of the tool holder base 31. The tool bits 34 can be turned about the pivot shaft 32 between the operative position where the tool bits 34 are extended out of the tool holder base 31, and the non-operative position where the tool bits 34 are received inside the tool holder base 31. After the tool bits 34 have been received in the tool holder base 31, the received first tool set 30 can be inserted into the receiving open chamber 11 of the case 10. After insertion of the first tool set 30 into the receiving open chamber 11 of the case 10, the friction resistance between the inside wall of the case 10 and the first tool set 30 keeps the first tool set 30 positively secured to the inside of the case 10.

Figure 4:
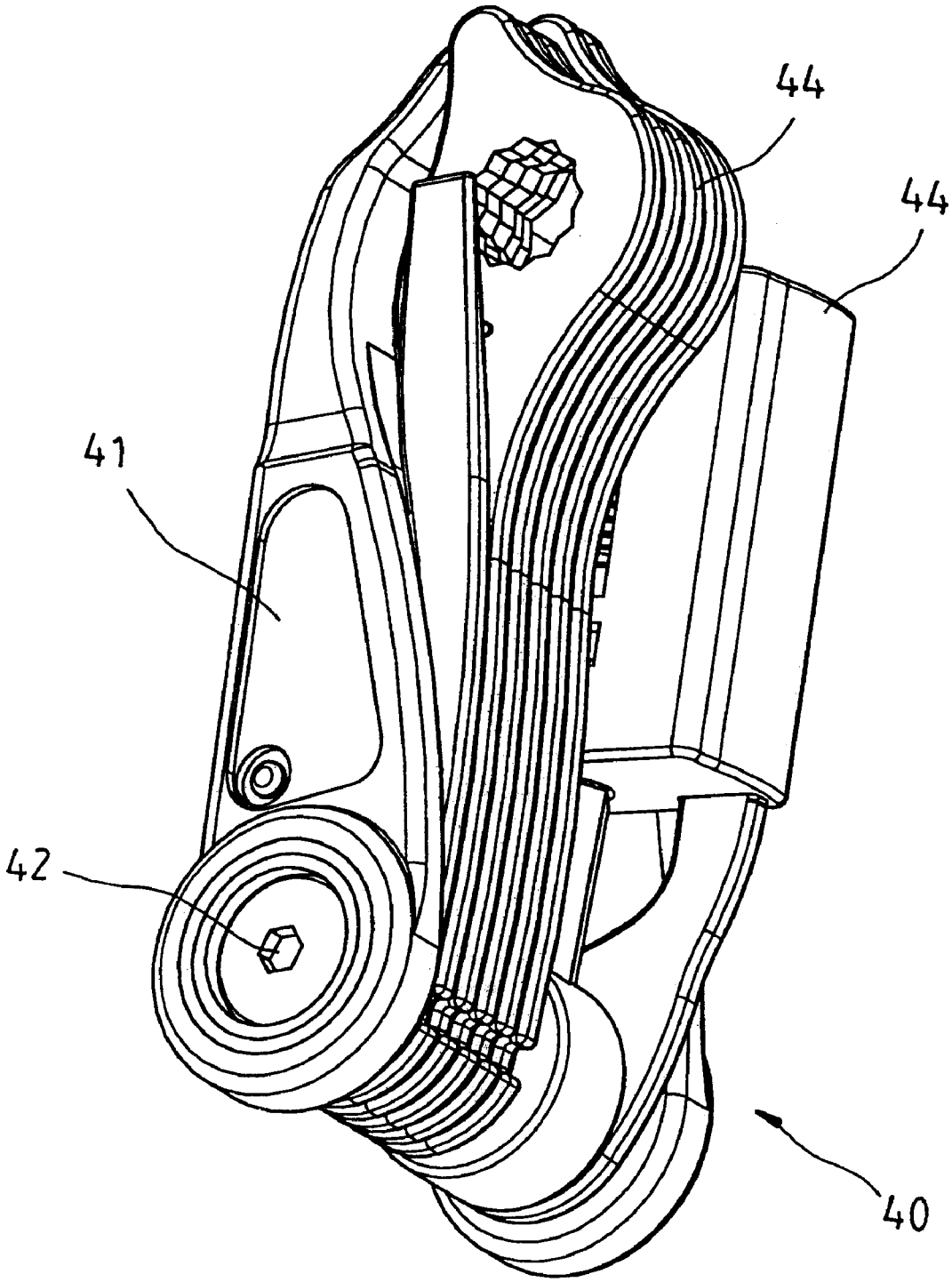
FIG. 4 is an elevational view of a second tool set for the combination bicycle tool kit according to the present invention, showing the tool elements received.
Figure 5:
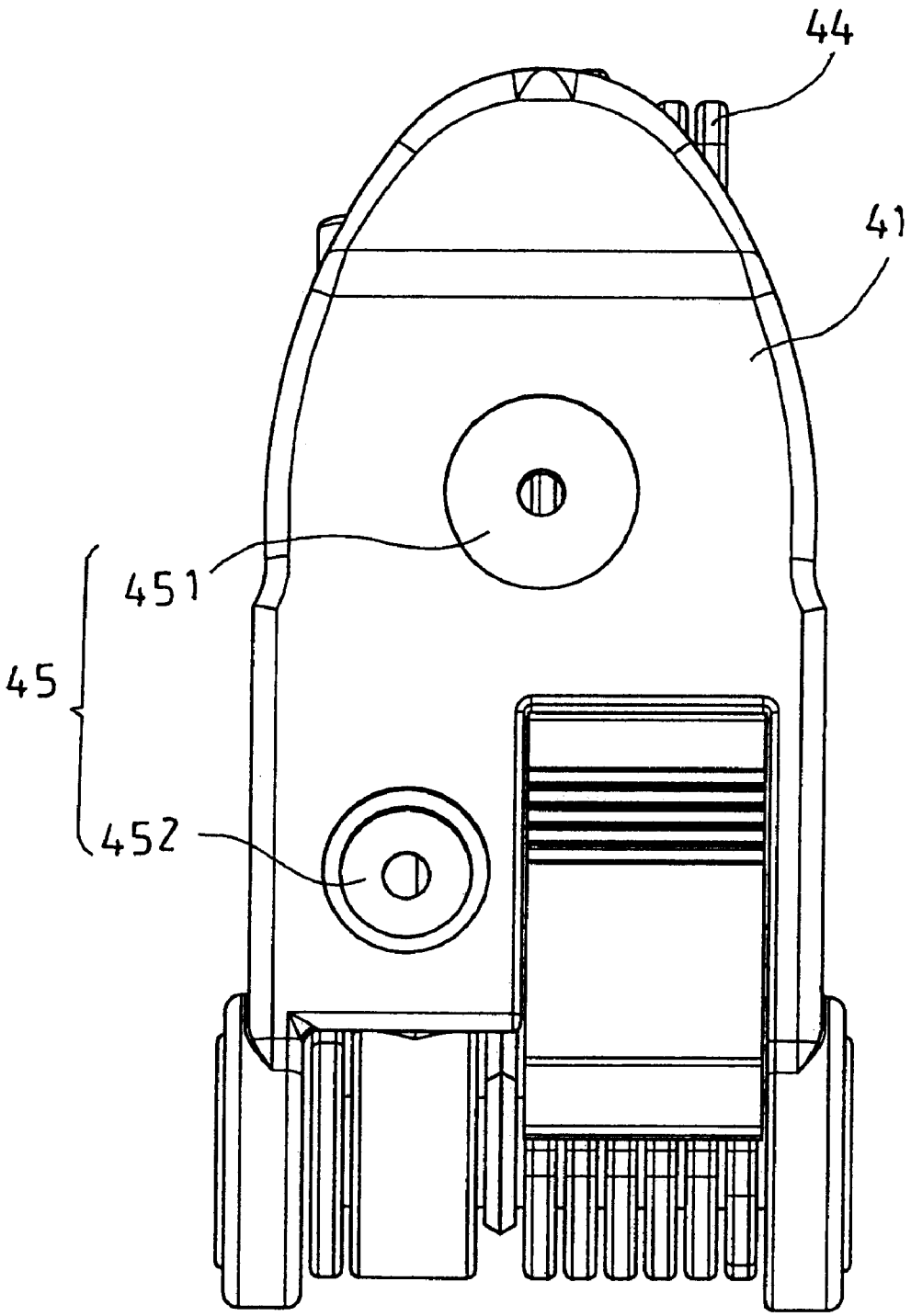
FIG. 5 is a backside view in an enlarged scale of a part of the second tool set shown in FIG. 4.

Referring to FIGS. 4 and 5, the second tool set 40 comprises a tool holder base 41, the tool holder base 41 comprising a pivot shaft 42 transversely disposed at one end thereof and a chamfered edge 43 disposed at the other end thereof (see also FIG. 6), a set of tool elements 44 respectively pivoted to the pivot shaft 42 of the tool holder base 41, and a coupling structure 45 integral with the tool holder base 41. The tool elements 44 can be turned about the pivot shaft 42 between the operative position where the tool elements 44 are extended out of the tool holder base 41, and the non-operative position where the tool elements 44 are received inside the tool holder base 41. The coupling structure 45 is comprised of a male retainer means 451 (for example a projection of a snap fastener) and a male retainer means 452 (for example a projection of a snap fastener) adapted to engage the female retainer means 151 and a male retainer means 152 of the case 10 respectively.

Referring to FIG. 1 again, the case 10 is injection-molded from plastics. After removal of the case 10 from the mold of the injection-molding machine, two through holes 16 are formed in the back sidewall thereof corresponding to the female retainer means 151 and male retainer means 152 of the coupling structure 15.

As stated above, the first tool set 30 and the second tool set 40 have a respective chamfered edge 33 or 43. By means of the chamfered edge 33 or 43, the tool set 30 or 40 can be used as a pry means to detach the bicycle tire. The tool sets 30 and 40 contain different tool means, for example, screwdrivers, wrenches, spanners, cutters, etc. After the first tool set 30 has been received in the receiving open chamber 11 of the case 10 and the second tool set 40 fastened to the coupling structure 15 of the case 10, the elastic band 20 is hung on the lugs 14 of the case 10 to secure the combination bicycle tool kit to one tubular member of the frame of the bicycle.

When using a particular tool (for example, a crossed screwdriver 34'), the first tool set 30 is removed from the case 10, keeping the second tool set 40 secured to the case 10. It is very convenient to use.

A prototype of combination bicycle tool kit has been constructed with the features of FIGS. 1~6. Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A combination bicycle tool kit comprising a case, said case having a receiving open chamber extended to one end thereof and a coupling structure integral with one sidewall thereof;

a first tool set, said first tool set comprising a tool holder base, the holder base of said first tool set comprising a pivot shaft transversely disposed at one end thereof, a chamfered edge disposed at an opposite end thereof, and a set of tool bits respectively pivoted to the pivot shaft of said first tool set and turned about the pivot shaft of said first tool set between the operative position where said tool bits are extended out of the tool holder base of said first tool set, and the non-operative position where said tool bits are received inside the tool holder base of said first tool set; and a second tool set, said second tool set comprising a tool holder base, the holder base of said second tool set comprising a pivot shaft transversely disposed at one end thereof and a chamfered edge disposed at an opposite end thereof, a coupling structure integral with the tool holder base of said second tool set for fastening to the coupling structure of said case to secure said second tool set to said case, and a set of tool elements respectively pivoted to the pivot shaft of said second tool set and turned about the pivot shaft of said second tool set between the operative position where said tool elements are extended out of the tool holder base of said second tool set, and the non-operative position where said tool elements are received inside the tool holder base of said second tool set.

2. The combination bicycle tool kit as claimed in claim 1 wherein the coupling structure of said case comprises at least one female retainer means, and the coupling structure of said second tool set comprises at least one male retainer means for fastening to the female retainer means of the coupling structure of said case respectively.

3. The combination bicycle tool kit as claimed in claim 2 wherein the retainer means are a projection and socket of a snap fastener.

4. The combination bicycle tool kit as claimed in claim 1 wherein said case comprises a positioning groove that fits the periphery of one tubular member of the frame of a bicycle.

5. The combination bicycle tool kit as claimed in claim 4 further comprising a fastener adapted to secure said case to one tubular member of the frame of a bicycle, keeping the positioning groove of said case engaged with the tubular member of the frame of the bicycle.

6. The combination bicycle tool kit as claimed in claim 5 wherein said fastener is an elastic band.

7. The combination bicycle tool kit as claimed in claim 6 wherein said case comprises two lugs disposed at two opposite sides for the mounting of said elastic band to secure said case to one tubular member of the frame of a bicycle.

8. The combination bicycle tool kit as claimed in claim 1 further comprising a fastener adapted to secure said case to one tubular member of the frame of a bicycle, keeping the positioning groove of said case engaged with the tubular member of the frame of the bicycle.

9. The combination bicycle tool kit as claimed in claim 8 wherein said fastener is an elastic band.

10. The combination bicycle tool kit as claimed in claim 9 wherein said case comprises two lugs disposed at two opposite sides for the mounting of said elastic band to secure said case to one tubular member of the frame of a bicycle.

* * * * *